United States Patent [19]

Kutami et al.

[11] Patent Number: 4,862,211

[45] Date of Patent: Aug. 29, 1989

[54] IMAGE-FORMING BELT SUPPORTING APPARATUS

[75] Inventors: Atsushi Kutami; Akira Hashimoto; Yoshihiro Takada, all of Numazu, Japan

[73] Assignee: Ricoh Co., Ltd., Tokyo, Japan

[21] Appl. No.: 61,055

[22] Filed: Jun. 10, 1987

[30] Foreign Application Priority Data

Jun. 19, 1986 [JP] Japan ..... 61-93948[U]
Jul. 18, 1986 [JP] Japan ..... 61-169460[U]
Sep. 17, 1986 [JP] Japan ..... 61-220480[U]

[51] Int. Cl.[4] ..... G03G 15/00
[52] U.S. Cl. ..... 355/212
[58] Field of Search ..... 355/3 BE, 16, 3 R, 133; 198/843, 842, 840, 845; 474/190

[56] References Cited

U.S. PATENT DOCUMENTS

| | | | |
|---|---|---|---|
| 3,327,839 | 6/1967 | Sigety et al. | 198/840 X |
| 4,140,014 | 2/1979 | Gradoni et al. | 474/190 X |
| 4,178,094 | 12/1979 | Silverberg | 355/3 BE |
| 4,221,480 | 9/1980 | Spehrley | 198/843 X |
| 4,561,757 | 12/1985 | Salomon et al. | 198/840 X |

*Primary Examiner*—R. L. Moses
*Attorney, Agent, or Firm*—Flynn, Thiel, Boutell & Tanis

[57] ABSTRACT

The present invention relates to an apparatus for conveying and rotating an image-forming belt while supporting said belt by at least two rolls, wherein the surface of at least one roll A of said rolls is short-fibre-embedded or wound up with thread or cloth. It is desirable to provide a meander-preventing guide at the side-end portions of said image-forming belt. In this case, it is desirable to attach a plastic-made washer to at least one side-end of said roll A so as to abut on said guide.

9 Claims, 1 Drawing Sheet

IMAGE-FORMING BELT SUPPORTING APPARATUS

BACKGROUND OF THE INVENTION (a) Field of the Invention

The present invention relates to an apparatus for conveying and rotating an image-forming belt while supporting said belt by at least two rolls.

(b) Description of the Prior Art

The image-forming belts such as electrophotographic element belt, electrostatic recording element belt and the like, as is well known, have comprised, providing on a belt-shaped support (which is normally made of a plastic film such as polyester film), a photoconductive layer, a dielectric layer and the like respectively. Generally speaking, the prior art image-forming belt supporting apparatus, as shown in FIG. 1, has been comprised of an image-forming belt 1 and at least two rolls, namely a driving roll 2*a* (which is normally made of hard rubber) and a driven roll 2*b* (which is normally made of a metal such as Al) and in addition a tension roll 2*c* (which is normally made of a metal such as Al) on request, said rolls being arranged to support said belt with the freedom of rotation and conveyance, wherein 3 is a meander-preventing guide provided each of the lateral end portions of the back (support side) of the belt 1. However, apparatus like this has been defective in that when these rolls are rotated in one direction, as shown in FIG. 2, between the inside (support side) of the belt 1 and the roll 2, there are rolled in foreign matters 4 such as shavings of the support and the guide of the belt 1, toners use in image formation and the like to form projections 5 on the surface of the flexible belt 1, whereby cracks break out on the belt 1 and so the utility thereof as the image-forming member deteriorates.

Figure 1:
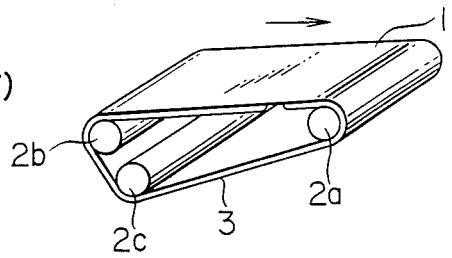
FIG. 1 (PRIOR ART)
FIG. 1 is a perspective view of a prior art image-forming belt supporting apparatus with a meander-preventing guide provided at its belt portion.
Figure 2:
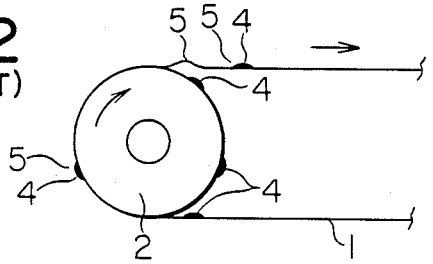
FIG. 2 (PRIOR ART)
FIG. 2 is a schematic view for explaining the defects inherent in the prior art.

In the drawings, the reference numbers identify parts as follows:

| | | | |
|---|---|---|---|
| 1 | image-forming belt | 2 | roll |
| 2a | driving roll | 2b | driven roll |
| 2c | tension roll | 3 | meander-preventing guide |
| 4 | foreign matters | 5 | projection |
| 6a | fibre | 6b | thread |
| 6c | cloth | 7.7' | washer |

SUMMARY OF THE INVENTION

The object of the present invention is to provide an image-forming belt supporting apparatus that has evaded the deterioration in utility as the image-forming member by preventing the occurrence of cracks on the belt caused by rolling in foreign matters, and has improved the durability.

Figure 3:
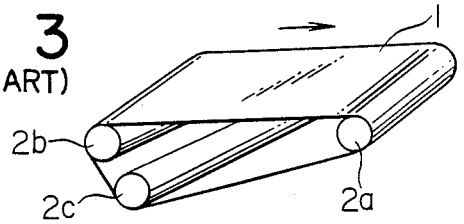
FIG. 3 (PRIOR ART)
FIG. 3 is a perspective view of an image-forming belt supporting apparatus lacking a meander-preventing guide at its belt portion.
Figure 4:
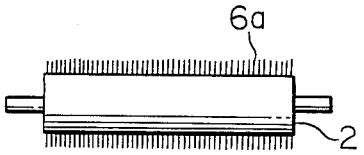
FIG. 4 is a side elevation view of one example of a fibre-embedded roll used in the apparatus according to the present invention.
Figure 5:
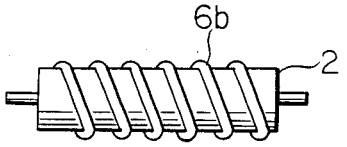
FIG. 5 and FIG. 6 each is a side view of an example of a thread or cloth-embedded roll used in the apparatus according to the present invention, and FIG. 7(*a*) and FIG. 7(*b*) are views explaining the state of having attached washers to the roll of the type shown in FIG. 4.
Figure 6:
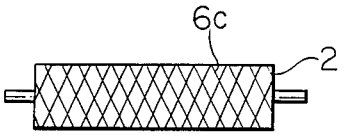

The supporting apparatus according to the present invention, as shown in FIG. 3, is arranged to convey and rotate an image-forming belt 1 while supporting said belt by at least two rolls 2*a*, 2*b*, 2*c* and is characterized in that as shown in FIG. 4, a short fibre 6*a* is embedded in the surface of at least one roll of the aforesaid rolls, or as shown in FIGS. 5–6, a thread 6*b* or a cloth 6*c* is wound around said surface. In this case, it is desirable to provide the meander-preventing guide, as usual, for example, on each of the lateral end portions of the image-forming belt.

In the case of the roll illustrated in FIG. 4, as the construction material of the fibre to be embedded there may be enumerated natural fibres such as wool, flax, silk, cotton and the like, and synthetic fibres such as nylon, rayon (regenerated cellulose), polyester, polypropylene and the like.

The proper diameter of said fibre is about 0.5–5 denier, and the proper length thereof is about 0.1–2 mm. The number of fibres used is about 1,000–100,000 pieces/cm$^2$, preferably about 10,000–50,000 pieces/cm$^2$. The roll like this may be prepared by embedding short fibres 6*a* in the circular surface of the roll 2 such as conventionally used metal roll, hard rubber roll or the like, substantially vertically and uniformly by means of an adhesive such, for instance, as an epoxy system adhesive.

In the case of rolls illustrated in FIG. 5–FIG.6, whilst, as the construction material of the thread and cloth, there may be enumerated various kinds of natural and synthetic fibres as in the case of the fibre to be embedded.

It is preferable that the thread diameter is about 0.1–2 mm, the distance between threads is about 0.1–2 mm, and the cloth mesh is about 50–400. The roll illustrated in FIG. 5 or FIG. 6 may be prepared by winding the circular surface of the conventional roll 2 with the thread 6*b* or cloth 6*c*, and if necessary fixing same by means of an adhesive.

Figure 7:
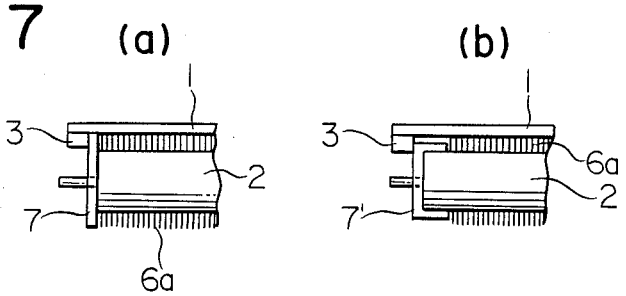

In the case where the meander-preventing guides have been provided on the lateral end portions of the belt, furthermore, it is preferable that the rolls illustrated in FIGS. 4–6 should be provided at least at one end thereof with plastic-made washers 7, 7' so as to abut the guide 3, as shown in for instance FIGS. 7(*a*) and (*b*), in order to further ensure the meander-preventing effect as well as eliminate the possibility of the guide portion of the belt running on the roll. FIG. 7(*b*) illustrates the example of using the roll whose both end portions have not been subjected to fibre-embedding processing (Both end portions are sometimes not subjected to fibre-embedding depending on processing methods. This is applicable to threads and cloths).

The members or materials other than the roll may be the exact same as usual ones.

The present invention will be explained with reference to example hereinafter.

DESCRIPTION OF THE PREFERRED EMBODIMENTS

EXAMPLE 1

A nylon fibre (0.5–1 mm in length and about 3 denier in diameter) was embedded in the whole circular surface of an aluminium roll for use in a photosensitive element belt (20 mmϕ×340 mm long) at the ratio of about 30000 pieces/cm$^2$ by means of an epoxy adhesive to thereby prepare a roll according to the present invention.

This roll was prepared two in number. Then, these two rolls were set as 2b and 2c inside a belt 1 (which is here a photosensitive belt provided at both ends with 0.5 mm-thick polyurethane rubber-made guides 3), and further a hard driving hard rubber roll being identical in size with said aluminium roll was set as 2a, as shown in FIG. 1, thereby preparing an image-forming belt supporting apparatus.

Next, this apparatus was incorporated in the image-forming part of Electrophotographic Copying Machine M-10 produced by RICOH and subjected to copy test to find that neither projections nor cracks were brought about on the surface of the photosensitive element belt alter having made 100,000 copies, because the foreign matters, such as the sprashed toners rolled in between the belt and rolls and the like, had entered in the voids formed on the fibre-embedded layer of the roll and had been caught therein.

EXAMPLE 2

An image-forming belt supporting apparatus was prepared according to the same procedure as Example 1 except that an aluminium roll (the same as used in Example 1), prepared by winding the whole circular surface once with a cotton thread (diameter: about 0.5 mm) at intervals of 0.5–1 mm and fixing same by means of an epoxy adhesive, was employed as 2b and 2c. The same copy test as Example 1 was carried out using said apparatus. The good results as observed in Example 1 were obtained.

EXAMPLE 3

An image-forming belt supporting apparatus was prepared according to the same procedure as Example 1 except that an aluminium roll (the same as used in Example 1), prepared by covering the whole circular surface with a about 100 mesh nylon cloth (a nylon stocking was used therefor) and fixing same by means of an epoxy adhesive, was employed as 2b and 2c. The same copy test as Example 1 was carried out using said apparatus. The good results as observed in Example 1 were obtained.

EXAMPLE 4

An image-forming belt supporting apparatus was prepared according to the same procedure as Example 1 except that 21 mmϕ polyacetal-made washers were attached to both ends of the one fibre-embedded roll 2b prepared according to Example 1 as shown at 7 in FIG. 6 (*a*).

The same copy test as Example 1 was carried out using said apparatus. The better results were obtained in respect of the meander of belt and destroy of guide, as compared with Example 1.

In the apparatus of the present invention, as stated above, at least one of the supporting rolls comprises embedded fibre in its surface or winding a wound thread or cloth around its surface. Therefore, even when the rolls are rotated in one direction and foregin matters such as sprashed toners and the like are rolled in between the rolls and the belt, those foreign matters enter in the voids formed in the surface layer of thus processed and are caught therein. Consequently, said foreign matters do not exert a bad influence upon the belt, namely the surface of the image-holding member, whereby the image-holding member does not deteriorate in faculty and accordingly is improved in durability. When the meander-preventing guide is provided at each of the both side-end portions of the belt and further said rolls are provided with washers, meandering of the belt and destroying of the guide can be prevented almost completely.

We claim:

1. In an apparatus used in conveying and rotating an image-forming belt used in electrophotographic and electrostatic processes while supporting said belt by at least two rolls, the improvement comprising:

the peripheral surface of at least one of said rolls has short fibres embedded therein and projecting outwardly therefrom or has thread or cloth wrapped therearound, the length, diameter and number of said fibres being respectively about 0.1–2 mm, about 0.5–5 denier and about 1,000–100,000 pieces/cm$^2$, the diameter and interval of said thread being respectively about 0.1–2 mm and about 0.1–2 mm, and the mesh of said cloth being about 50–400.

2. An apparatus according to claim 1, wherein said image-forming belt is provided at its lateral end portions with a meander-preventing guide.

3. An apparatus according to claim 2, wherein at least one end of said at least one roll is provided with a washer so as to abut said guide.

4. An apparatus according to claim 1, wherein the number of rolls is three, at least one roll being a fibre-embedded one.

5. An apparatus according to claim 1, wherein at least one roll is a fibre-embedded one.

6. An apparatus according to claim 1, wherein said short fibres are nylon fibres about 0.5–1 mm in length and about 3 denier in diameter.

7. An apparatus according to claim 1, wherein said thread is a cotton thread.

8. An apparatus according to claim 1, wherein said cloth is a 100 mesh nylon cloth.

9. An apparatus comprising an elongated, endless, image-forming belt having an inner surface and an outer surface, said belt comprising a substrate and a photoconductive layer or a dielectric layer on said substrate;

at least two transversely extending, spaced-apart rolls contacting the inner surface of said belt and supporting said belt for movement through an endless path, the lateral edge portions of said belt projecting laterally outwardly beyond the adjacent lateral ends of said rolls, at least one of said rolls having spaced-apart fibre means projecting outwardly from the outer surface thereof a distance of from 0.1 to 2 mm and into contact with the inner surface of said belt, said fibre means defining cavities therebetween for receiving particles therein, a pair of endless meander-preventing guides secured to the inner surface of said belt and extending lengthwise along said lateral edge portions thereof, said meander-preventing guides projecting inwardly from said inner surface of said belt and being disposed laterally outwardly from the adjacent ends of said rolls, washers on said adjacent ends of said rolls and slidably contacting the laterally inner ends of said meander-preventing guides so that movement of said belt is guided by said meander-preventing guides and said washers, said fibre means covering the entire surface of said one roll between said washers.

* * * * *